US005190003A

United States Patent [19]

Voigt

[11] Patent Number: 5,190,003

[45] Date of Patent: Mar. 2, 1993

[54] CYLINDER BLOCK FOR AN INTERNAL COMBUSTION ENGINE

[75] Inventor: Dieter Voigt, Wolfsburg, Fed. Rep. of Germany

[73] Assignee: Volkswagen AG, Wolfsburg, Fed. Rep. of Germany

[21] Appl. No.: 846,607

[22] Filed: Mar. 5, 1992

[30] Foreign Application Priority Data

Mar. 13, 1991 [DE] Fed. Rep. of Germany ..... 4108050

[51] Int. Cl.[5] ..... F02F 7/00

[52] U.S. Cl. ..... 123/195 R; 123/41.42

[58] Field of Search ..... 123/41.42, 41.72, 41.74, 123/195 R, 41.84

[56] References Cited

U.S. PATENT DOCUMENTS 4,440,118 4/1984 Stang et al. ..... 123/41.42
4,715,335 12/1987 Elsbett et al. ..... 123/41.42

FOREIGN PATENT DOCUMENTS 0227383 7/1987 European Pat. Off. .
1210248 8/1966 Fed. Rep. of Germany .
2140377 2/1973 Fed. Rep. of Germany .

*Primary Examiner*—Noah P. Kamen
*Attorney, Agent, or Firm*—Brumbaugh, Graves, Donohue & Raymond

[57] ABSTRACT

A cylinder block for an internal combustion engine consists of an upper section containing cylinders and cooling chambers and a lower section having an upwardly facing opening to receive the upper section so as to form an annular oil compartment surrounding the cylinders and below the cooling chambers.

4 Claims, 1 Drawing Sheet

CYLINDER BLOCK FOR AN INTERNAL COMBUSTION ENGINE

BACKGROUND OF THE INVENTION

This invention relates to cylinder blocks for internal combustion engines having reciprocating pistons which are provided with cooling chambers and oil compartments adjacent to the pistons.

German Offenlegungsschrift No. 21 40 377 discloses a one-piece cylinder block which has a cooling jacket surrounding the cylinders and lubricant reservoir lateral thereto. A disadvantage of that design is its production cost, since its manufacture requires the use of cores for the closed coolant and lubricant chambers.

German Patent No. 12 10 248 and European Patent No. 0 227 383 A2 disclose a cylinder block with a cooling jacket which is formed by providing a cylinder head inserted into an upwardly open crankcase section with a gap between the outer wall of the cylinder head and the adjacent wall of the crankcase section to provide a cooling space. In these cases the cylinders are part of a cylinder head which also has the gas exchange passages for the engine but has no oil compartment.

SUMMARY OF THE INVENTION

Accordingly, it is an object of the present invention to provide a cylinder block for an internal combustion engine which overcomes the disadvantages of the prior art.

Another object of the invention is to provide a cylinder block having coolant chambers and an oil compartment which is compact and simple to manufacture and retains advantageous properties of conventional constructions while avoiding the necessity for providing connecting lines to an external oil reservoir.

These and other objects of the invention are attained by providing a cylinder block having a first section containing cylinders and cooling chambers and a second section in which the first section is received in sealed relation and providing an oil compartment which is formed between the first and second sections. With this arrangement, the second section can be provided with an open part to receive the first section by using a simple core design and if a sand core is used the opening may be cleaned easily. With this arrangement it is also possible to produce the second section of the cylinder block by pressure casting, so that it can be made with a light metal. Another advantage of the invention is that it permits great freedom in the choice of material for the first section of cylinder block in which the cylinders are formed. For example, that section may consist of gray cast iron, as has become accepted practice with thin walls between adjacent cylinders.

In accordance with the invention, the cooling chambers in the first section and the chamber between the sections forming the oil compartment are adjacent in the axial direction of the cylinders so that the partition separating them permits heat transmission between them. Such direct heat transmission, in conjunction with the fact that the volume of the cooling chambers is restricted to that required for adequate heat removal during operation, ensures rapid warm-up of the engine, with the advantage of reduced fuel consumption and exhaust emission during warm-up.

The invention also permits the use of a deeper-drawn cooling water jacket at locations which are especially critical with respect to cooling, for example in the fused region of cylinder linings.

Finally, another advantage of the two part cylinder block arrangement according to the invention is that the cylinder-containing section of the cylinder block can be replaced in the event of damage without modification of the second section of the block, which may contain the crankshaft bearings.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENT

Figure 1:
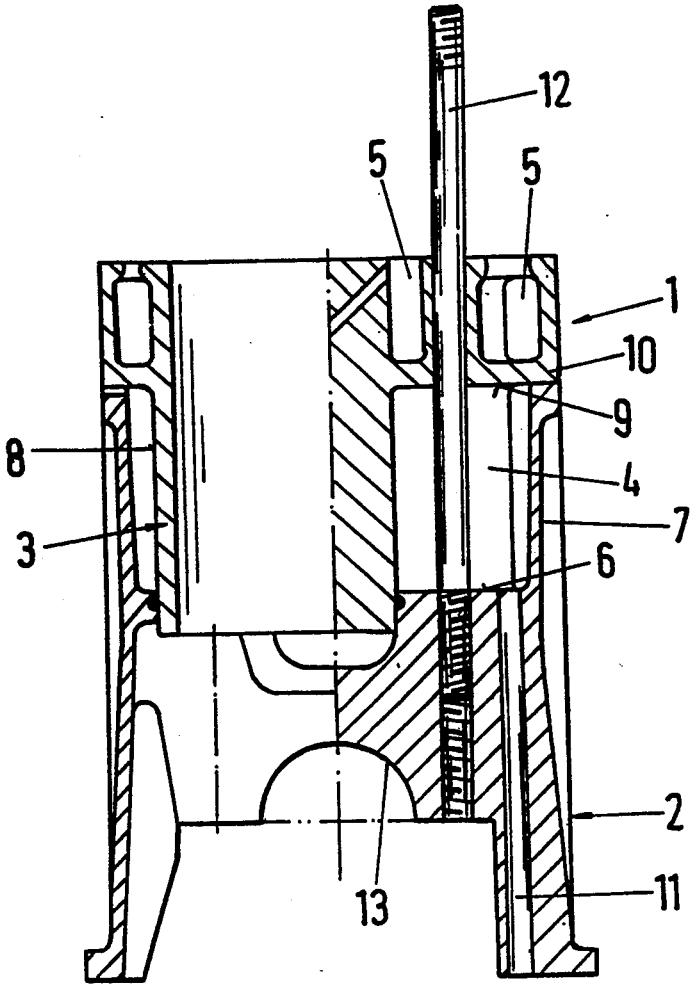
FIG. 1 is a longitudinal sectional view, taken along the line I—I in FIG. 2, illustrating a representative cylinder block arranged according to the invention.
Figure 2:
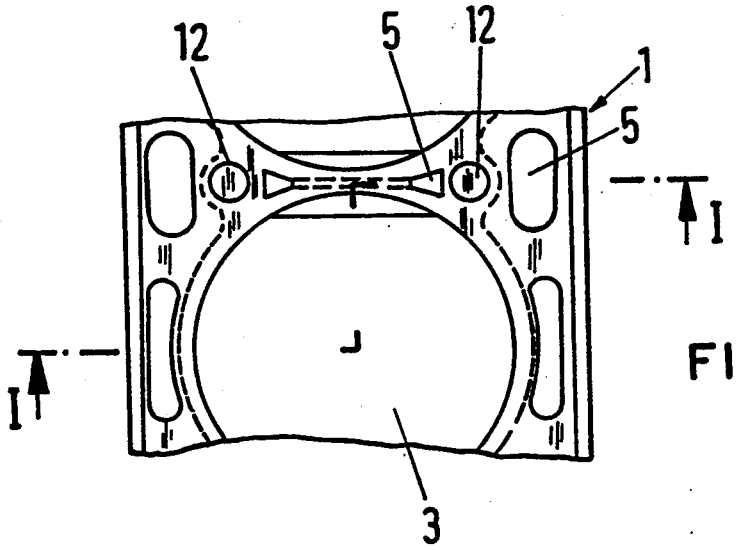
FIG. 2 is a top view showing a portion of the cylinder block shown in FIG. 1.

The typical embodiment of a cylinder block according to the invention which is illustrated in the drawings consists of a first section 1 and a second section 2, the first section 1 being arranged to have a cylinder head mounted on its top surface. The head is not shown because it is of conventional structure, but it includes gas exchange passages and valves as well as valve control cams. The first section includes a lower part 3 containing the cylinders and extending downwardly into the second section, which is upwardly open, forming an annular space 4 surrounding the part 3. Coolant chambers 5 are cast into the first section 1 adjacent to the combustion chamber portions of the cylinders and an oil compartment, bounded by walls of both the first section and the second section, is provided by the annular chamber 4 beneath the cooling chambers. The second section 2 includes a bottom wall 6 and a side wall 7 which is free from any internal undercuts, defining the annular space 4. Moreover, the inner wall of the annular space 4 is the outer shell 8 of the lower part 3 of the first section 1, which also has a downwardly facing surface 9 forming the upper wall of the annular space. It will be understood that the two housing parts 1 and 2 are tightly assembled using suitable sealing members.

A partition 10 between the cooling chambers 5 and the annular space 4, forming the upper wall of the annular space 4, may, if desired, be optimized for purposes of heat exchange between coolant in the chamber 5 and oil in the space 10 by providing, for example, surface projections or the like. This will shorten the warm-up phase of the engine.

An oil passage 11 connects the annular space 4 to an oil tank (not shown).

The assembly of the two sections 1 and 2 is effected by tension rods 12. The cylinder head, not shown, is positioned on top of the first section 1. The top ends of the rods 12 are screwed into the cylinder head, while their bottom ends are screwed into the bottom sections 2 in the region of a main bearing seat 13 for the crankshaft. Of course the two sections 1 and 2 may alternatively be assembled in another manner, for example, by screws holding only those two parts together.

The invention thus provides a cylinder block which has an ideal structure in terms of manufacture and assembly.

Although the invention has been described herein with reference to a specific embodiment, many modifications and variations therein will readily occur to those skilled in the art. Accordingly, all such variations and modifications are included within the intended scope of the invention.

I claim:

1. A cylinder block for an internal combustion engine comprising a first section containing cylinders and cooling chambers adjacent to the combustion chamber portion of the cylinders and having a downwardly projecting portion, and a second section having an upwardly facing opening receiving the downwardly projecting portion of the first section in sealed relation and forming an annular space therebetween providing an oil compartment which is isolated from the cooling chambers, the second section providing the outer wall of the annular space.

2. A cylinder block according to claim 1, including a wall in the first section separated the cooling chambers therein from the oil compartment to provide heat exchange therebetween.

3. A cylinder block according to claim 1 including at least one oil line in the second section opening into the annular space.

4. A cylinder block according to claim 1 including tension bolts extending through the annular space for holding the first and second sections together.

* * * * *